US008191171B2

(12) United States Patent
O'Hara

(10) Patent No.: US 8,191,171 B2
(45) **Date of Patent: *Jun. 5, 2012**

(54) WETSUIT

(75) Inventor: Tetsuya O'Hara, Ojai, CA (US)

(73) Assignee: Patagonia Inc., Ventura, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 12/783,340

(22) Filed: May 19, 2010

(65) Prior Publication Data

US 2010/0269238 A1 Oct. 28, 2010

Related U.S. Application Data

(63) Continuation of application No. 12/127,710, filed on May 27, 2008, now Pat. No. 7,743,428, which is a continuation of application No. 11/347,458, filed on Feb. 3, 2006, now Pat. No. 7,395,553.

(51) Int. Cl.
*B63C 11/04* (2006.01)
*B63C 11/10* (2006.01)

(52) U.S. Cl. ..... 2/2.16; 2/2.17; 2/2.15

(58) Field of Classification Search ..... 2/2.15–2.17
See application file for complete search history.

(56) References Cited

U.S. PATENT DOCUMENTS

| | | | | |
|---|---|---|---|---|
| 412,784 | A | | 10/1889 | Orr |
| 2,749,551 | A | | 6/1956 | Garbellano |
| 2,981,954 | A | | 5/1961 | Garbellano |
| 3,081,517 | A | | 3/1963 | Driesch |
| 3,284,806 | A | | 11/1966 | Prasser |
| 3,374,142 | A | | 3/1968 | Kreckl |
| 4,274,158 | A | | 6/1981 | Pogorski et al. |
| 4,741,050 | A | | 5/1988 | O'Kane et al. |
| 4,862,517 | A | | 9/1989 | Meistrell |
| 5,118,780 | A | * | 6/1992 | Hirai et al. ..... 528/83 |
| 5,144,729 | A | | 9/1992 | Austin et al. |
| 5,196,240 | A | | 3/1993 | Stockwell |
| 5,282,277 | A | | 2/1994 | Onozawa |
| 5,898,934 | A | * | 5/1999 | Hunter et al. ..... 2/2.15 |
| 5,993,972 | A | * | 11/1999 | Reich et al. ..... 428/423.1 |
| 6,286,145 | B1 | | 9/2001 | Welchel et al. |

(Continued)

FOREIGN PATENT DOCUMENTS

EP 1588635 A1 10/2005

(Continued)

OTHER PUBLICATIONS $O_3$ Eco Wash 21, Kurabo, www.kurabo.co.jp (6 pgs).

(Continued)

*Primary Examiner* — Bobby H Muromoto, Jr.
(74) *Attorney, Agent, or Firm* — Christie, Parker & Hale, LLP

(57) ABSTRACT

A wetsuit includes an outer layer and an inner layer. The inner layer is attached to the outer layer and includes a plurality of fibers having wool and being configured in a plurality of clusters. The inner layer also includes a plurality of interconnected channels. At least a portion of each channel is defined by a space between adjacent clusters. The wetsuit also includes an opening that is disposed on a rear side of the wetsuit. The wetsuit additionally includes at least one fastener that is connected to the opening to open and close the opening.

8 Claims, 2 Drawing Sheets

U.S. PATENT DOCUMENTS

| | | | | |
|---|---|---|---|---|
| 6,353,049 | B1 * | 3/2002 | Doi et al. | 524/432 |
| 6,406,788 | B1 * | 6/2002 | Doi et al. | 428/364 |
| 6,464,672 | B1 | 10/2002 | Buckley | |
| 6,675,389 | B1 * | 1/2004 | Kublick | 2/2.17 |
| 7,096,506 | B2 | 8/2006 | Ragot | |
| 7,395,553 | B2 * | 7/2008 | O'Hara | 2/2.15 |
| 7,743,428 | B2 * | 6/2010 | O'Hara | 2/2.16 |
| 2001/0014981 | A1 * | 8/2001 | Fairhurst et al. | 2/69 |
| 2001/0047530 | A1 * | 12/2001 | Griffiths | 2/2.17 |
| 2003/0172429 | A1 * | 9/2003 | Chuang | 2/2.15 |
| 2003/0173698 | A1 * | 9/2003 | Chuang | 264/139 |
| 2003/0182704 | A1 * | 10/2003 | Sunada et al. | 2/2.15 |
| 2004/0177427 | A1 | 9/2004 | Pedrick | |
| 2004/0237599 | A1 * | 12/2004 | Kondou et al. | 66/202 |
| 2004/0253891 | A1 | 12/2004 | Schierenbeck et al. | |
| 2005/0005337 | A1 | 1/2005 | Yokoyama | |
| 2005/0028241 | A1 | 2/2005 | Ragot | |
| 2005/0071905 | A1 * | 4/2005 | Polak et al. | 2/2.16 |
| 2005/0102862 | A1 | 5/2005 | Baychar | |
| 2005/0132509 | A1 * | 6/2005 | Chuang et al. | 8/444 |
| 2005/0155128 | A1 * | 7/2005 | Hayes | 2/2.15 |
| 2005/0284560 | A1 | 12/2005 | Chuang | |
| 2006/0010929 | A1 * | 1/2006 | Chuang et al. | 66/171 |
| 2006/0260018 | A1 | 11/2006 | Gordon et al. | |

FOREIGN PATENT DOCUMENTS

| | | | |
|---|---|---|---|
| EP | 1590235 | B1 | 7/2006 |
| FR | 2731592 | A1 | 9/1996 |
| FR | 2789651 | A1 | 8/2000 |
| GB | 2401024 | B | 4/2005 |
| JP | 03059150 | A | 3/1991 |
| JP | 10-337797 | A | 12/1998 |
| WO | WO 2004/069649 | A1 | 8/2004 |

OTHER PUBLICATIONS

Pinnacle 2003/2004 Catalog, Pinnacle Aquatics (44 pgs).
Pinnacle 2004/2005 Catalog, Pinnacle Aquatics (44 pgs).
Pinnacle 2005/2006 Catalog, Pinnacle Aquatics (44 pgs).
Priority Document, PCT/GB2004/000418, dated Feb. 19, 2004 (6 pgs).
European Search Report dated Mar. 7, 2007 for European Application No. 06252183.6, European Search Report mailed Mar. 19, 2007; Patagonia, Inc. (6 pgs.).
International Search Report dated Sep. 24, 2007 and mailed Nov. 2, 2007, Corresponding to PCT/US07/02888 (3 pgs.).
PCT Written Opinion of the International Searching Authority dated Sep. 26, 2007 and mailed Nov. 2, 2007, Corresponding to PCT/US07/02888 (8 pgs.).

* cited by examiner

WETSUIT

CROSS REFERENCE TO RELATED APPLICATIONS

The present application is a continuation of U.S. application Ser. No. 12/127,710, filed May 27, 2008 now U.S. Pat. No. 7,743,428, which is a continuation of U.S. application Ser. No. 11/347,458, filed on Feb. 3, 2006 and issued on Jul. 8, 2008 as U.S. Pat. No. 7,395,553, the disclosures of which are incorporated herein by reference.

BACKGROUND

The present disclosure generally relates to clothing for use in water, and more particularly, to a wetsuit.

Wetsuits are typically used by swimmers, surfers, and divers when water temperature is below comfortable or safe levels. Wetsuits include an outer layer that is constructed from Neoprene, which can stretch so that the wetsuit conforms to the user's body when worn. The outer layer provides a degree of insulation and warmth to the user. Wetsuits may also include an additional inner layer constructed from a synthetic knit fabric. The synthetic knit fabric provides insulation for the wetsuit in addition to the Neoprene outer layer. The synthetic knit fabric inner layer also retains some of the water that enters the wetsuit.

Synthetic materials generally have lower heat retention characteristics than natural insulation materials. Thus, the user may feel uncomfortable or cold when wearing such wetsuits. Additionally, the synthetic inner layer is closely knit to feel smooth next to the user's skin and to trap the water that enters the wetsuit. As a result, the water trapped in the synthetic inner layer does not drain easily. Thus, drying performance of wetsuits having a synthetic inner layer may not be satisfactory.

In view of the above, there is a need for a wetsuit that can remedy one or more of the above described problems associated with current wetsuits.

SUMMARY OF THE INVENTION

Features and advantages of the present disclosure will become apparent from the following description of the preferred embodiments, taken in conjunction with the accompanying drawings, which illustrate, by way of example, the principles of the disclosure.

In accordance with one aspect of the present disclosure, a wetsuit includes an outer layer and an inner layer. The inner layer is attached to the outer layer and includes a plurality of fibers having wool and being configured in a plurality of clusters. The inner layer also includes a plurality of interconnected channels. At least a portion of each channel is defined by a space between adjacent clusters.

In accordance with another aspect of the present disclosure, a wetsuit includes an outer layer and an inner layer. The inner layer includes a first layer and a second layer. The first layer includes an outer side and an inner side. The outer side of the first layer is attached to the outer layer. The second layer is disposed on the inner side of the first layer and includes a plurality of fibers including wool and configured in a plurality of spaced apart clusters to define a plurality of interconnected channels between the plurality of clusters.

In accordance with yet another aspect of the present disclosure, a wetsuit includes an outer layer and an inner layer. The inner layer is attached to the outer layer and includes a plurality of fibers having wool and being configured in a plurality of clusters. The inner layer also includes a plurality of interconnected channels. At least a portion of each channel is defined by a space between adjacent clusters. The wetsuit also includes an opening that is disposed on a rear side of the wetsuit. The wetsuit additionally includes at least one fastener that is connected to the opening to open and close the opening.

DETAILED DESCRIPTION OF THE INVENTION

Figure 2:
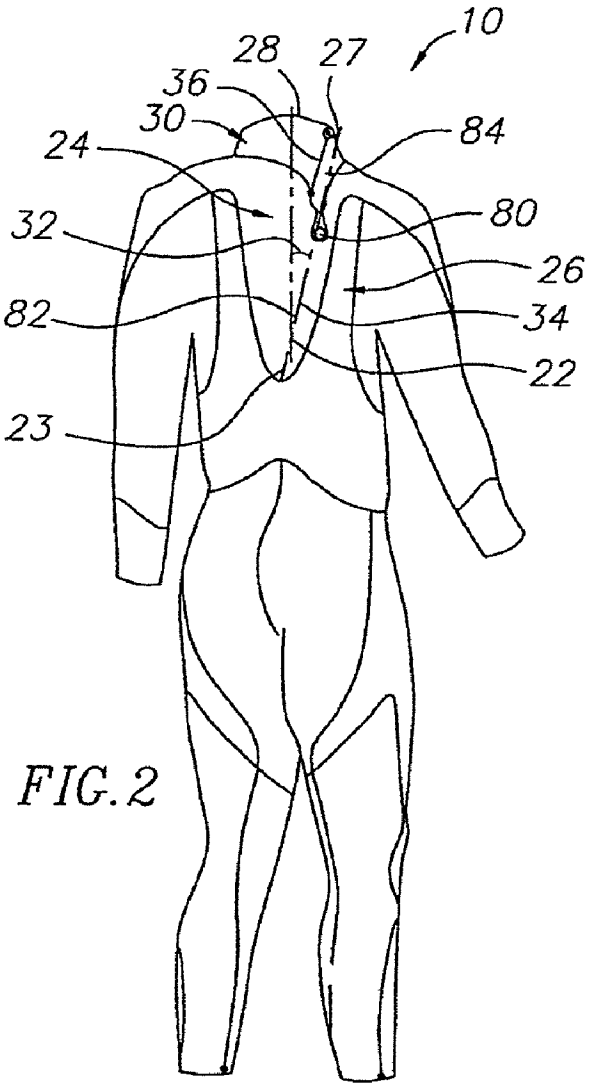
FIG. 2 is a rear perspective view of the wetsuit of FIG. 1.
Figure 1:
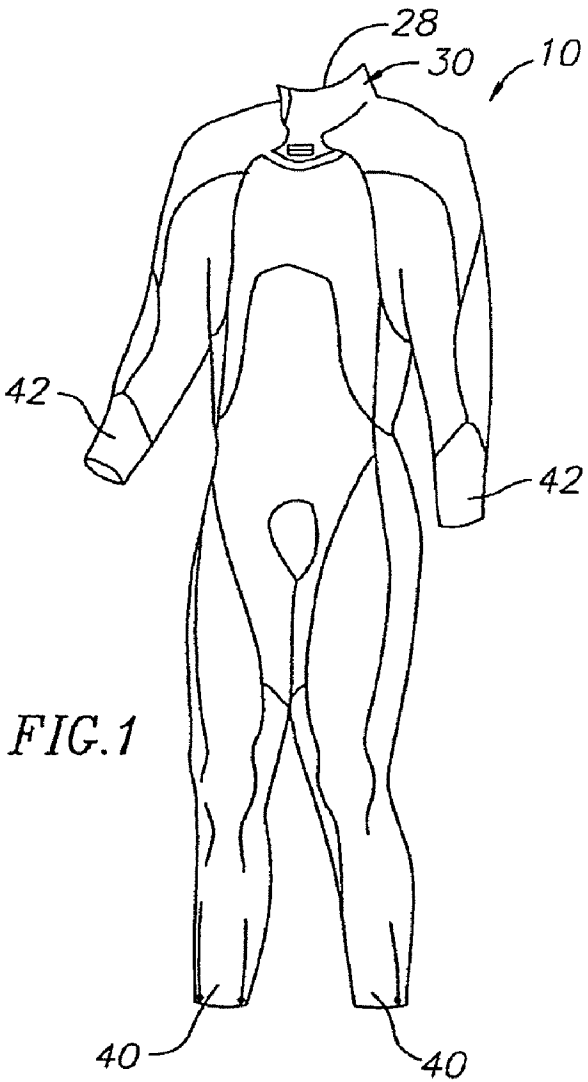
FIG. 1 is a front perspective view of a wetsuit constructed in accordance with the teachings of the present disclosure.
Figure 3:
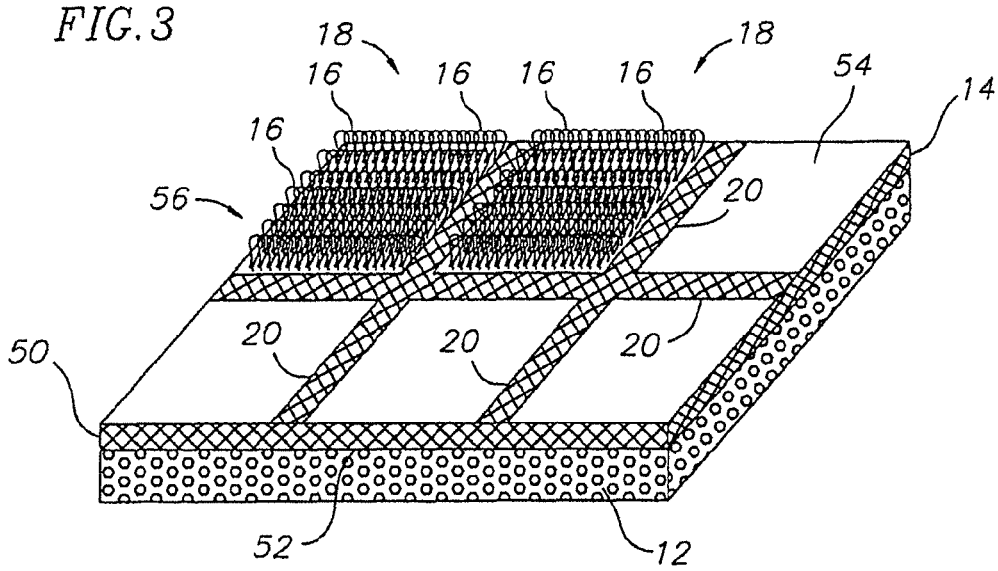
FIG. 3 is a perspective and schematic cross sectional view of a wetsuit constructed in accordance with the teachings of the present disclosure.

Referring to FIGS. 1-3, a wetsuit 10 constructed in accordance with the teachings of the present disclosure is shown. The wetsuit 10 includes an outer layer 12 and an inner layer 14 (shown in FIG. 3) that is attached to the outer layer 12. The outer layer 12 is the layer of the wetsuit 10 that may be directly exposed to water when the wetsuit 10 is worn by a user (not shown). The inner layer 14 may be adjacent to or in contact with the skin 15 (shown in FIG. 5) of the user. The inner layer 14 includes a plurality of fibers 16 that are configured in clusters 18 on the inner layer 14. The plurality of fibers 16 may only include wool fibers 16. Alternatively, the plurality of fibers 16 may include a combination of wool fibers and fibers constructed from other natural or synthetic materials. The inner layer 14 also includes a plurality of interconnected channels 20. A portion of each channel 20 is defined by the space between adjacent clusters 18. Each fiber 16 of all or a substantial number of the plurality of fibers 16 is configured in a loop shape that extends outward, i.e., toward the skin 15 of the user, from the inner layer 14. The wetsuit 10 may also include one or more openings on the front or back of the wetsuit 10 at any desired orientation (e.g., vertical or diagonal) for donning and doffing the wetsuit 10. In the disclosed example, an opening 22 (shown in FIG. 2) is disposed on the back of the wetsuit 10 that extends from a first position 23 at approximately a spine region 24 below a shoulder blade region 26 to a second position 27 at approximately an upper edge 28 of a neck region 30 at an angle 32 relative to the spine region 24. The opening 22 may be opened and closed by one or more fasteners, such as a zipper. In the disclosed example, however, the opening 22 is opened and closed by a first fastener 34 and a second fastener 36.

The wetsuit 10 is shown in FIGS. 1 and 2 to be a full body wetsuit. However, the wetsuit 10 may be any type of wetsuit 10 that can be used for water activities. For example, the wetsuit 10 may be one or a combination of a vest, a trunk, or a half-body suit. In the exemplary wetsuit 10 shown in FIGS. 1 and 2 and described herein, the wetsuit 10 is a full body wetsuit that covers the body of a user from ankles and wrists to neck. When a user wears the wetsuit 10, the wetsuit 10 can be sufficiently sealed against water entering the wetsuit 10 at the ankle cuffs 40, the wrist cuffs 42 and the neck region 30, which may be referred to herein as extremities. The noted extremities can be stretchable and conform to the body parts to which they correspond to substantially prevent water from entering the wetsuit 10. However, some water may enter between the wetsuit 10 and the skin 15 of the user. The water can remain in the wetsuit 10 so as to function as an insulator. Thus, any water entering the wetsuit 10 from the neck region 34, the ankle cuffs 40 and the wrist cuffs 42 may actually retain some of the body heat emanating from the user. Water can also enter the wetsuit 10 through the opening 22 to the extent allowed by the fasteners 34 and 36. Therefore, during use of the wetsuit 10, the inner layer 14 may retain both air and water adjacent the skin 15 of the user.

Figure 4:
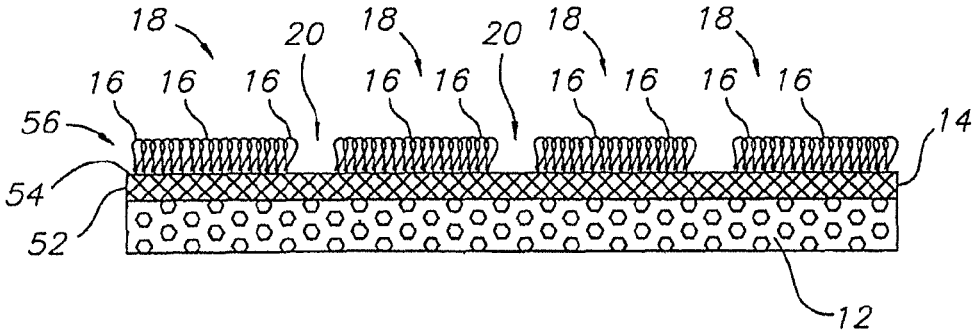
FIG. 4 is a schematic cross sectional view of a wetsuit constructed in accordance with the teachings of the present disclosure.
Figure 5:
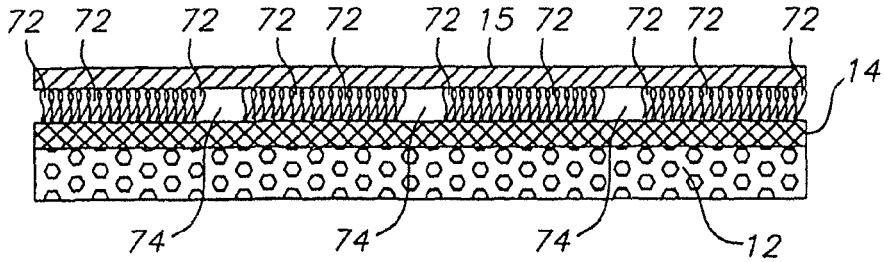
FIG. 5 is a wetsuit of FIG. 4 shown adjacent to the skin of a user.

Referring to FIGS. 3-5, the outer layer 12 is constructed from Neoprene. Neoprene is stretchable and includes closed internal cells that provide buoyancy and insulation when used in water. Additionally, Neoprene does not allow water to pass therethrough, thereby providing a water barrier for the wetsuit 10. The number of closed cells and the size thereof can be varied based on the process by which the Neoprene is manufactured. In the disclosed wetsuit 10, the Neoprene used for the outer layer 12 may have a large number of small cells to provide light weight, heat retention, and high stretchability. For example, the outer layer 12 can be constructed from Neoprene having a closed cell ratio of 90% or higher.

The inner layer 14 includes a first layer 50 with an outer side 52 and an inner side 54. The inner layer 14 also includes a second layer 56. The outer side 52 of the first layer 50 is attached to the outer layer 12. The second layer 56 includes the plurality of fibers 16, which is disposed on the inner side 54 of the first layer 50 and can contact the skin 15 of a user. The first layer 50 can be selected from any type of material that can be securely attached or laminated to Neoprene and be nearly as stretchable as Neoprene. In the disclosed example, the first layer 50 is constructed from Polyester and/or Polyurethane, the combination of which can be as stretchable as Neoprene and be securely laminated to Neoprene with an adhesive or other methods that are known in the art. The first layer 50 has a knitted construction, such as a jersey knit, and may be constructed from approximately 80-95% Polyester and approximately 5-20% Polyurethane.

The inner layer 14 includes the low pile Polyester and Polyurethane knit layer, which defines the first layer 50, and the plurality of fibers 16 forming a high pile layer, which defines the second layer 56. The plurality of fibers 16 can be knitted to the first layer 50 in the clusters 18 and can extend outward from the inner side 54 of the first layer 50. The spaces between the clusters 18 form the interconnected channels 20. Thus, the interconnected channels 20 may be defined by the sides of adjacent clusters 18 foaming walls of the channels 20 and the low pile knit layer, i.e., the first layer 50, forming the floor of the channels 20 between the adjacent clusters 18.

The fibers 16 may only include wool fibers. Alternatively, the fibers 16 may include a combination of wool fibers and fibers constructed from other natural or synthetic materials. Wool has low heat conductivity compared to most synthetic and naturally occurring materials. For example, the heat conductivity of wool is approximately 0.9 cal/cm·sec, as compared to the heat conductivity of Nylon and Polyester at approximately 6.0 and 5.0 cal/cm·sec, respectively. Accordingly, by constructing all or a number of the plurality of fibers 16 from wool, the heat emanating from the user of the wetsuit 10 can be maintained in the wetsuit 10 to keep the user warm. To prevent the wool fibers 16 from causing itching of the user's skin 15, the average diameter of the wool fibers 16 may be approximately 19.5 microns or less. Additionally, the wool fibers 16 can be treated with Ozone to reduce possible shrinking and itchiness of the wool fibers 16.

Each cluster 18 may only include a plurality of wool fibers 16. Alternatively, each cluster 18 may additionally include fibers 16 that are constructed from other materials in order to provide one or more desired characteristic that wool alone may not provide. Alternatively yet, each fiber 16 can be a braided, twisted, knit, or have other composite construction of a wool fiber and other natural or synthetic fibers. In the disclosed example, however, a plurality of the fibers 16 in each cluster 18 is constructed from wool, while the remaining fibers 16 in the cluster 18 can be constructed from Polyester. Polyester provides bulk or spring-like functionality for each cluster 18 that the wool fibers alone may not provide. In the disclosed example, each cluster 18 can include from approximately 10-80% wool fibers 16 and 90-20% Polyester fibers 16. For example, the second layer 56 may be constructed from approximately 67% wool and approximately 33% Polyester. Accordingly, if each cluster 18 includes nine looped fibers 16 in a 3×3 rectangular arrangement, three of the fibers 16, or one row of three fibers 16 can be constructed from Polyester, while the remaining fibers 16 can be constructed from wool. However, one cluster 18 may include more wool fibers 16 than Polyester fibers 16 and another cluster 18 may include more Polyester fibers 16 than wool fibers 16. Thus, although the distribution of the fibers 16 that are constructed from different materials may be different in each cluster 18, portions of the second layer 56 having a plurality of clusters 18 can include an approximately even distribution of fibers 16 from the constituent materials from which the second layer 56 is constructed.

The fibers 16 are arranged in a closely knit loop construction, which is commonly referred to as a terry loop construction. Each fiber 16 forms a loop shape that extends outward from the first layer 50 (i.e., toward the skin 15 of a user). The closely knit loop construction of the plurality of fibers 16 provides spaces in the loop of each fiber 16 and between the fibers 16, in which air can be trapped or maintained. One or ordinary skill in the art will readily recognize that air has low heat conductivity (approximately 0.6 cal/cm·sec). The trapped air can absorb and maintain the heat emanating from a user's skin 15. Accordingly, the closely knit loop construction of the second layer 50, in addition to the wool construction of all or a number of the plurality of fibers 16 provides insulation for the user of the wetsuit 10.

As described above, the inner layer 14 includes a first layer 50 and a second layer 56 having the clusters 18. Each cluster 18 includes the plurality of fibers 16 that are knit on the first layer 50. The plurality of fibers 16 in each cluster 18 can be knitted to the first layer 50 to form the second layer 56. Accordingly, each cluster 18 can be disconnected from an adjacent cluster 18 by a portion of an adjacent channel 20. In the disclosed example, however, adjacent rows of spaced apart clusters 18 are continuously knitted to the first layer 50. The clusters 18 in each row are connected by the fibers that form the clusters 18 of the row. The clusters 18 of adjacent rows, however, are not connected. The fibers that form each row of clusters 18 are knitted to the first layer 50 in a relatively flat configuration between the clusters 18 compared to the terry loop configuration of the plurality of fibers 16. Accordingly, the fibers that connect the clusters 18 may cover portions of the channels between the clusters 18 in a relatively flat knitted configuration. Thus, the inner layer 50 can be constructed with adjacent rows of clusters 18 being knitted to the first layer 50 to form a grid of clusters 18, which defines the second layer 56.

As described in the foregoing, the inner layer 14 includes the clusters 18 and the interconnected channels 20. The clusters 18 and the channels 20 form a grid that may be uniform or have varying geometric properties. For example, in FIGS. 3-5, the clusters 18 and the channels 20 are shown to form a rectangular grid on the inner layer 14, with each cluster 18 being approximately the same size and spaced apart approximately equally. However, the sizes and shapes of the plurality of fibers 16, the clusters 18, and/or the channels 20 can be configured at any portion of the wetsuit 10 to provide a desired characteristic for the inner layer 14. For example, certain portions of the wetsuit may require more insulation or heat retention as compared to other portions of the wetsuit 10. Accordingly, the size and density of the clusters 20 may be determined to provide additional heat retention in comparison to other portions of the wetsuit 10. In another example, certain portions of the wetsuit 10 may have to stretch more than other portions. These portions may compress the plurality of fibers 16 against the user's body more than the other portions of the wetsuit 10. To provide the same heat retention or insulation properties throughout the wetsuit 10, the height, thickness, shape, and material constituents of plurality of fibers 16 at the overly stretched portions can be determined to provide a desired insulation or heat retention property. The width, interconnectedness, shape and depth of the channels 20 can also be varied at any portion of the wetsuit 10 to provide a desired insulation or heat retention property.

Referring to FIG. 5, when the wetsuit 10 is worn by a user, the stretching of the wetsuit 10 causes the plurality of fibers 16 to compress against the skin 15 of the user. The loop shape of each fiber 16 in cooperation with adjacent fibers provide air pockets 72 between the skin 15 of the user and the first layer 50. Additional air pockets 74 are also provided by the channels 20. The loop shape of each fiber also provides a spring-like or elastic property that collectively with the plurality of fibers 16 prevents full compression of the fibers 16 to maintain the air pockets 72 and 74 between the first layer 50 and the user's skin 15. Even if the plurality of fibers 16 are fully compressed so as to substantially diminish the size of the air pockets 72, the air pockets 74 formed by channels 20 still remain as a result of the compressed height of the plurality of fibers 16 forming the walls of the air pockets 74.

The wetsuit 10 can be dried after each use by being arranged and/or oriented such that the wet portions of the wetsuit 10 can be exposed to air and water can drain from the extremities of the wetsuit 10. As is known to those of ordinary skill in the art, un-descaled wool such as ozone treated wool can dry relatively faster than other types of natural or synthetic fibers. Additionally, wool fibers have a natural oil on the outer surface thereof that provides water repellency. The natural oil is also present on un-descaled wool such as ozone treated wool Accordingly, by using un-descaled wool such as ozone treated wool for the fibers 16, the inner layer 12 of the wetsuit 10 can be water repellent, which can result in the wetsuit 10 drying quickly. Furthermore, the water repellency of the fibers 16 cause water to quickly flow from the clusters 18 to respective adjacent channels 20 to be drained from the wetsuit 10 through the channels 20. Thus, the wetsuit 10 can be dried quickly by a combination of the water repellency of the wool fibers 16 along with the grid arrangement of the clusters 18 and the channels 20, which provides quick flow of water to outside the wetsuit. The wetsuit 10 can be draped over or hung from an object so that any water inside the wetsuit 10 can drain through the extremities. The wetsuit 10 can also be turned inside out to expose the inner layer 12 to air. To accelerate the draining process, however, a user can turn the wetsuit 10 inside out and run his or her hand over the clusters 18 with some pressure to squeeze the water out of the air pockets 72 and into the channels 20. Therefore, with the channels 20 of the inner layer 14, the wetsuit can be quickly drained from excess water so that it can dry quickly.

An example of a wetsuit vest constructed in accordance with the teachings of the present disclosure, which will be referred to as a test wetsuit, was compared to a wetsuit having only a Nylon knit inner layer, which will be referred to as a Nylon knit wetsuit. Both the test wetsuit and the Nylon knit wetsuit included a 3 mm thick Neoprene outer layer. Both wetsuits were tested when dry and in a room having a temperature of approximately 20° Celsius (68° Fahrenheit). Both wetsuits were tested on a manikin having a constant surface temperature of 33° Celsius (91.4° Fahrenheit). Temperature measurements at the chest region of the manikin resulted in a CLO rating of approximately 0.69 for the test wetsuit and approximately 0.36 for the Nylon knit wetsuit. The CLO rating is used to rate heat retention of clothing and generally indicates the amount of clothing required by a resting subject to be comfortable at a room temperature of 21° Celsius (70° Fahrenheit). Therefore, under the noted test conditions, the test wetsuit retained nearly twice the amount of the heat emanating from the manikin as compared to Nylon knit wetsuit.

Referring to FIG. 2, the opening 22 extends from a first position 23 at approximately the spine region 24 below the shoulder blade region 26 to the second position 27 at approximately the upper edge 28 of the neck region 30 at an angle 32 relative to the spine region 24. The opening 22 may be opened and closed by one or more fasteners. In the disclosed example, however, the opening 22 is opened and closed by a first fastener 34 and a second fastener 36. The first fastener 34 may be a zipper having a zipper pull 80 that can open and close a first portion 82 of the opening 22. The first portion 82 extends from the first position 23 to above the shoulder blade region 26 at the angle 32 from the spine region 24. The zipper 34 is connected to the first portion 82 such that pulling up the zipper 34 can close the first portion 82 and pulling down the zipper 34 can open the first portion 82. The second fastener 36 may be a Velcro® closure that can open and close a second portion 84 of the opening 22. The second portion 84 can continue from the first portion 82 and extend to the second position 27 at the angle 32. Therefore the first portion 82 and the second portion 84 are connected to define the opening 22. In the disclosed example, the angle 32 is determined by a distance of approximately 2.5 inches between the second position 27 and the spine region 24 at the neck region 30. The angle 32 allows a user to bend easily without the fasteners 34 and 36 hindering or resisting such bending.

The neck region of the wetsuit 10 is an extremity of the wetsuit 10, and as described in the foregoing, can provide substantial sealing against water entering the wetsuit 10. Because the second fastener 36 is constructed from a Velcro® closure, the width of the Velcro® closure can be determined so as to provide wide ranging closure configurations to compensate for varying neck sizes of the users of the wetsuit 10. Accordingly, a user can close the Velcro® closure so that the neck region of the wetsuit 10 substantially and elastically conforms to the user's neck to provide substantial sealing at the neck region 30.

From the foregoing, it will be appreciated that a wetsuit constructed in accordance with the teachings of the present disclosure traps air in wool fibers between the outer layer of the wetsuit and the user's body to provide insulation for a user. Additionally, the grid pattern of the inner layer of the wetsuit along with the wool fibers of the inner layer provide quick drying of the wetsuit after each use. While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A apparel for use in water comprising:

an outer layer; and an inner layer attached to the outer layer, the inner layer comprising a plurality of fibers configured in a plurality of clusters defining a plurality of interconnected channels between said clusters, wherein each of said plurality of channels comprises a width, wherein each of said plurality of clusters comprises a width and a length, wherein said width and length of each of said plurality of clusters is each greater than the width of each of said plurality of channels.

2. The apparel of claim 1, wherein the plurality of fibers in each cluster comprise adjacent looped fibers extending outward from the inner layer.

3. The apparel of claim 1, wherein the plurality of fibers comprise wool.

4. The apparel of claim 3, wherein the plurality of fibers further comprise Polyester fibers.

5. The apparel of claim 1, wherein the inner layer comprises a knit fabric including a layer of Polyester and Polyurethane, and wherein the layer of Polyester and Polyurethane is attached to the outer layer.

6. The apparel of claim 5, wherein the outer layer comprises Neoprene, and wherein the layer of Polyester and Polyurethane is laminated to the Neoprene.

7. The apparel of claim 1, further comprising an opening disposed on a rear side of the apparel and at least one fastener for fastening closed said opening.

8. The apparel of claim 1, wherein the outer layer is made from an elastic waterproof material.

* * * * *